US005133657A

United States Patent [19]

Harris

[11] Patent Number: 5,133,657

[45] Date of Patent: Jul. 28, 1992

[54] HIGH TURNDOWN SHEET METAL ATMOSPHERIC GAS BURNER

[75] Inventor: James A. Harris, Wichita, Kans.

[73] Assignee: Harmony Thermal Co. Inc., Wichita, Kans.

[21] Appl. No.: 716,513

[22] Filed: Jun. 17, 1991

[51] Int. Cl.[5] ..... F23D 3/40

[52] U.S. Cl. ..... 431/326; 431/346; 431/354; 126/92 AC; 239/145

[58] Field of Search ..... 431/326, 328, 346, 354; 126/92 AC; 239/145

[56] References Cited

U.S. PATENT DOCUMENTS

| | | | |
|---|---|---|---|
| 3,053,316 | 9/1962 | Flynn | 431/328 X |
| 3,177,923 | 4/1965 | Hine, Jr. et al. | 431/346 X |
| 3,512,910 | 5/1970 | Hein | 431/154 |
| 4,569,657 | 2/1986 | Laspeyres | 431/326 |
| 4,723,907 | 2/1988 | Norton et al. | 431/354 |
| 4,887,963 | 12/1989 | LeMer | 431/328 X |

FOREIGN PATENT DOCUMENTS

| | | | |
|---|---|---|---|
| 1264332 | 2/1972 | United Kingdom | 431/328 |

*Primary Examiner*—Larry Jones

[57] ABSTRACT

A sheet metal atmospheric gas burner capable of a 5:1 turndown ratio is disclosed. The burner is intended for application in instantaneous water heaters and other gas burning appliances having high input modulation requirements. It has a hollow cylindrical burner head fabricated of sheet metal, a single mixer tube, and slotted ports arranged on the vertically-oriented cylinder sidewall. The unique features of the burner are the tabbed slotted port design, the use of fins adjacent to port rows to eliminate flame blowoff and assure quiet burner operation, and the arrangement of ports on the burner head to simultaneously provide good secondary aeration at all inputs and flame carry to all ports at all inputs. The advantages of the burner are its simplicity, low cost, and ease of manufacture, relative to its demanding performance requirements.

1 Claim, 2 Drawing Sheets

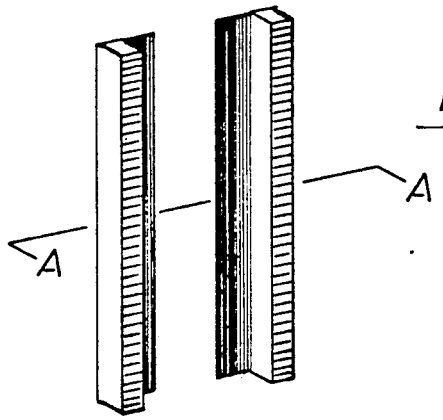
FIG. 2
FIG. 3
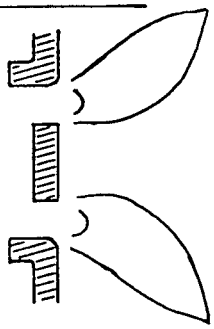
FIG. 4
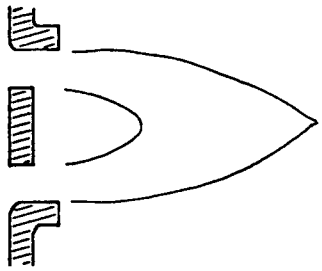
FIG. 5
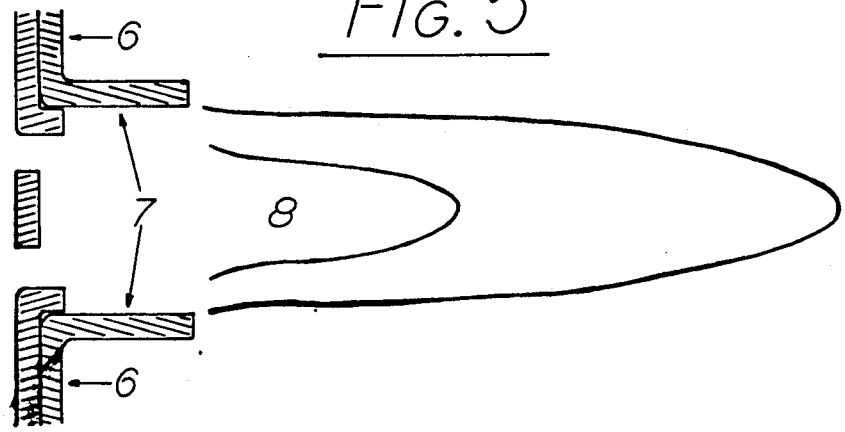

HIGH TURNDOWN SHEET METAL ATMOSPHERIC GAS BURNER

BACKGROUND OF THE INVENTION

1. Field of the Invention

This invention is in the field of atmospheric gas burners designed to operate over a wide range of inputs.

2. Discussion of the Background

It is often desirable in the design of gas-fired equipment, for instance instantaneous water heaters or circulating hot water boilers, to provide a gas fuel delivery apparatus that can automatically vary the flow of gas to the burner in response to a change in load. Regarding an instantaneous water heater, for example, water flows through the heat exchanger at variable rates depending on the hot water withdrawal rate at one or more remote taps. In addition to variable flow rate, the water may enter the heater at varying temperatures depending, for instance, on the season of the year. Since the intent of the heater is to deliver hot water at a specified temperature, it follows that the burner must deliver heat at a rate proportional to the flowrate through the heat exchanger and the temperature rise from inlet to outlet that accords with the desired outlet temperature. Many instantaneous water heaters incorporate a mechanism which varies the gas flowrate to the burner in response to changes in the load placed on the heater as described above.

A similar situation with regard to varying loads can pertain to hot water circulating boilers as well. In this case, the heat exchanger is part of a circuit through which water or some other fluid is pumped. In some instances, the flowrate through the heat exchanger can vary; for instance in a zone heating circuit served by one or more pumps. Also, a change in load can be reflected in a change in the temperature rise effected in the water passing through the heat exchanger. In some boiler applications, it is desirable to run the boiler at various outlet temperatures, depending for instance on the outdoor temperature (space heating application) or domestic hot water draw (for the case where the boiler also heats domestic water either directly or indirectly through another heat exchanger).

Such a heating appliance for domestic application requires a specially designed burner that can operate over a wide range of inputs. Cost considerations argue for an atmospheric Bunsen type burner as opposed to a power burner. A power burner can give higher turndown ratios, but is considerably more expensive to manufacture than an atmospheric burner. At present, the practical limit for turndown ratio for an atmospheric gas burner is about 5:1; that is to say, the minimum input at which the burner can acceptably operate is one-fifth of its maximum input.

For application to the aforementioned variable-input heating appliances, the operational criteria for an atmospheric burner are as follows:

1. It must perform acceptably over an input range of 5:1.

2. It should produce less than 200 ppm of carbon monoxide (on an airfree basis) over about 110% of its operating range. (This is somewhat more strict than the American Gas Association standard, but it is an achievable goal.)

3. It must light reliably with a spark ignitor or other ignition means and the flame must carry around to all ports after ignition, regardless of input.

4. The flame must be resistant to being blown out, and must carry back around after being blown off a portion of the ports, regardless of input.

5. The flame must not flash back into the mixer tube after the burner is shut off.

6. The flame must not lift or blow off the ports, and the burner should operate without excessive noise at all inputs.

7. The burner must not produce excessive yellow flame. This is a problem that can arise when using propane and other higher molecular weight gaseous fuels at high input. Even though the flame may be producing very little carbon monoxide under yellow flame conditions, the danger exists for soot deposition on any surface that is near a yellow flame.

It is desirable from the standpoint of manufacturing cost to fabricate the burner from sheet metal instead of castings or forgings. In addition to the savings in material, in using sheet metal, the ports can be punched rather than drilled, which considerably simplifies the production process.

However, making the burner head out of sheet metal introduces considerable difficulty insofar as meeting the aforementioned seven operational criteria, particularly at all inputs for a high-turndown burner. This is because of design tradeoffs; that is to say, moving the design in one direction in order to better meet one criterion can often have an adverse effect on another criterion. For example, in order to minimize blowoff and/or yellow flame problems at high input, the port area must be increased. However, if the port area is high, then the port velocity at low input will be very low, resulting in a marginal flame that is prone to being blown out and has poor flame carry-around characteristics. Another problem that sheet metal burners are particularly prone to is flashback. Flashback can occur when the gas-air velocity through the port is lower than the flame propagation velocity in the gas-air mixture. When this occurs, the flame has a tendency to propagate back through the port and into the burner head, resulting in a loud pop and flame shooting back out through the mixer tube. Flashback is most likely just after the burner is shut down from a low input. The port velocity starts to drop to zero, and the flame propagates back into the burner head, igniting the residual gas-air mixture inside. The reason sheet metal burners are particularly prone to this problem is that the port channel is very short. In a cast burner head with drilled ports, the port channel is long. When the flame starts to carry back through a long port channel, its temperature is quenched by the relatively cool metal of the burner head, and it is extinguished. With a short channel, the metal does not provide a sufficient heat sink to extinguish the flame before it gets through to the gas inside. The way the flashback problem is dealt with in sheet metal burners is to make the ports small. Small diameter circular ports can be used, and often narrow slotted ports are used.

A typical example of the sheet metal atmospheric gas burners designed for variable input, as applied to instantaneous water heaters, can be found in Hein, U.S. Pat. No. 3,512,910. This burner has multiple horizontal burner bars. A gas manifold has a discharge orifice for each burner bar. This burner meets the operational criteria, but is somewhat complex and expensive to manufacture. Another burner which uses similar horizontal burner bars, but has a single mixer tube and is fed from a single gas discharge orifice, is Norton et al., U.S. Pat. No. 4,723,907. Although it requires only one discharge orifice, this burner is still relatively complex and expensive to manufacture.

SUMMARY OF THE INVENTION

The burner disclosed herein is an atmospheric burner with a hollow cylindrical burner head fabricated of sheet metal, a single mixer tube, and slotted ports arranged on the sidewall of the cylinder. The burner is designed for high turndown and for use in the variable input appliances described above, but is also simple and inexpensive. The burner head is oriented so that the sidewall is vertical; consequently, the gas exits the ports in a substantially horizontal direction. The burner meets the seven aforementioned operational criteria over a 5:1 range of inputs (for instance 20,000-100,000 btu/hr). The key to the success of this inherently simple burner in meeting such demanding requirements is in three features:

1. The port design
2. The pattern of porting on the burner sidewall
3. The extended surfaces which are employed adjacent to port rows.

The patentable novelty of the burner resides in these three features.

The primary advantage of this burner is its relative simplicity of design in comparison to the atmospheric burners which are typically used in variable input appliances, while still meeting the requirements for this application. Another advantage is that the use of a burner with a single mixer tube simplifies the design of the gas train feeding the burner. A single gas discharge orifice may be used rather than a manifold with multiple, discharge orifices.

BRIEF DESCRIPTION OF THE DRAWINGS

FIG. 2 shows the detail of a port pair.

FIG. 3 shows the cross section of a port pair through section A—A with the tabs on the inside of the burner head and the resultant flame pattern.

FIG. 4 shows the cross section of a port pair through section A—A with the tabs on the outside of the burner head and the resultant flame pattern.

FIG. 5 shows the cross section of a port pair through section A—A and having the extended fins attached, showing the flame at high input.

DETAILED DESCRIPTION OF THE PREFERRED EMBODIMENT

Figure 1:
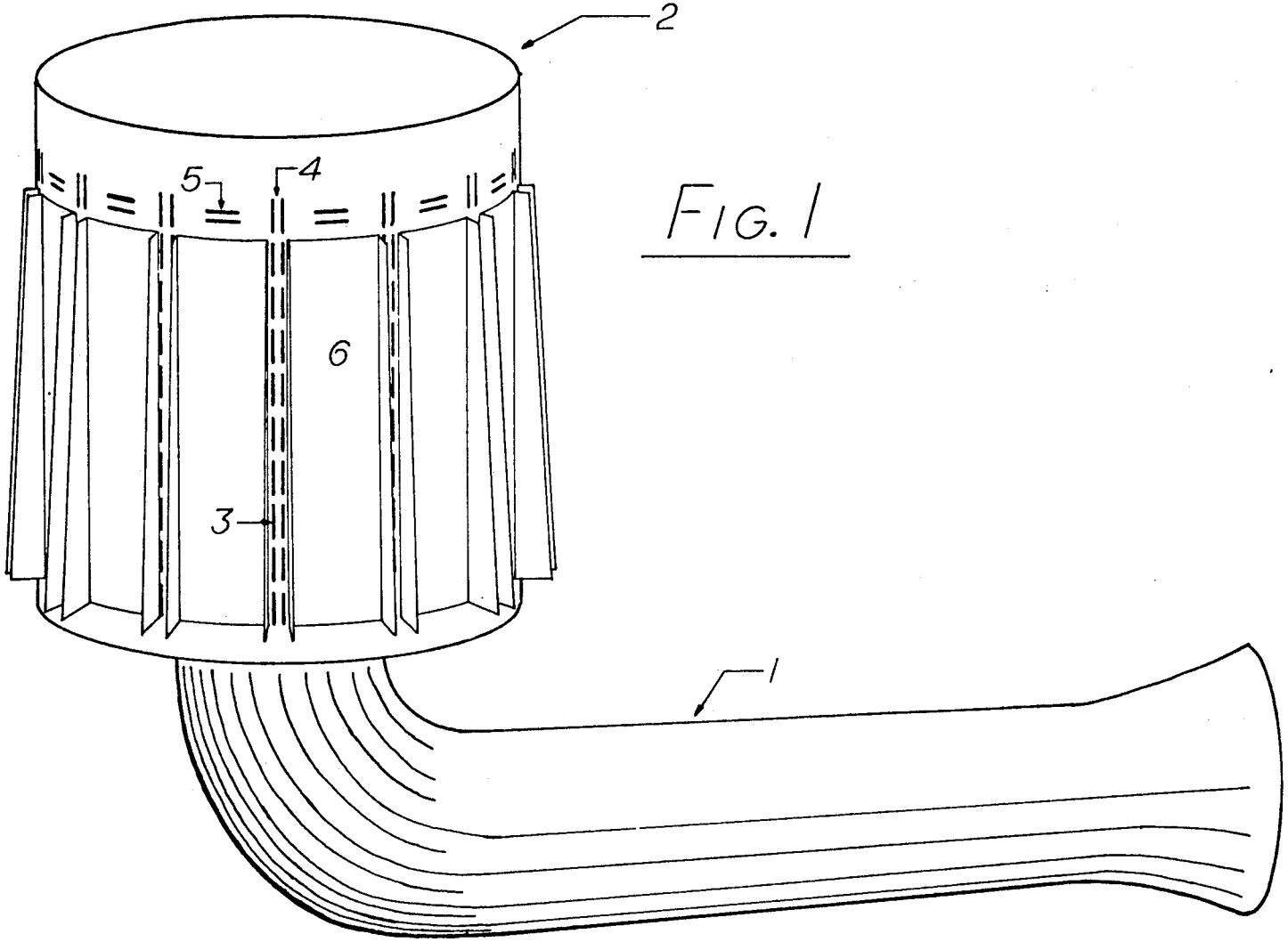
FIG. 1 shows the burner.

FIG. 1 shows the complete burner. A single mixer tube 1 is shown with a throat located a short distance from the inlet, and a 90-degree bend to bring the gas-air mixture vertically in through the bottom of the burner head 2, which is a hollow can fabricated of sheet metal. The gas-air mixture burns from port pairs 3, 4, and 5, which have been punched in the burner head sidewall as shown. Sheet metal pieces 6 have been formed and are attached by tack welding or other suitable method to the burner head as shown, in order to provide fins adjacent to the lower portion of each vertical port row.

FIG. 2 shows the detail of a port pair that has been punched in the sheet metal burner head 2. The punching process does not remove any material. Rather, it shears the sheet metal on three sides of the rectangular port, and then bends the material out in a tab. It is generally most convenient to punch the ports in pairs, as shown. Typical dimensions are as follows (inches): port length, 0.25; port width, 0.025; sheet metal thickness, 0.018; distance between ports in a port pair, 0.050. The narrow width of the port (0.025 inches) is necessary in order to prevent flashback.

FIGS. 3, 4, and 5 show cross sections of the port pair through section A—A.

In FIG. 3 is shown the nature of the flame burning from a port pair with the tabs projecting to the inside of the burner head. Two distinct flames are produced, directed to either side of the port pair. This phenomenon can be used to advantage in designing a port array to assure flame carry to all ports at low burner input, as will be explained below.

In FIG. 4 is shown the nature of the flame burning from a port pair with the tabs projecting to the outside of the burner head. The flames are directed towards each other, producing in essence a single flame jet centered on the port pair.

On a burner head having both tab-in and tab-out ports, one can observe that the flame jets from the tab-out ports are considerably longer than those from the tab-in ports. This indicates that the discharge coefficient for the tab-out ports is higher than that for the tab-in ports. Thus, one generally designs the port array to be largely made up of tab-out ports so that the number of ports necessary for a given peak input is kept as low as possible.

A problem that can arise at high input is flame lifting or blowoff. This occurs when the gas-air velocity from the port is substantially higher than the flame propagation velocity, making it impossible for the flame to attach near the port. The blowoff problem can be eliminated by the use of extended surfaces (fins) adjacent to the ports, as shown in FIG. 5. The fin creates a boundary layer of slower-moving gas adjacent to inner surfaces 7, allowing the flame to propagate back along the outer portion of the gas jet. The flame at high input looks as shown in FIG. 5, where a non-burning region 8 of high-velocity gas is surrounded by a burning shell of lower-velocity gas. Thus, the effect of the fins is to keep the flame attached to the burner head at high input; this not only assures good complete combustion, but also quiets the burner, eliminating the "blowtorch" sound associated with detached flames.

With this background, the burner head design shown in FIG. 1 can be explained more fully. Ports 3, which lay in a vertical row between the projecting fins of pieces 6, are all tab-out port pairs. Ports 4 are tab-in port pairs, and ports 5 are tab-out port pairs. By far the greatest amount of combustion is from the vertical rows of tab-out ports 3, and the fins assure that the flames stay attached at high input. The purpose of the top ring of ports 4 and 5 is to assure that the flame will carry to all ports when the burner is lit, even if it is lit at its lowest input. Lighting takes place at the bottom of a vertical row, and flame passes up the row to the tab-in port at the top of the row. This port directs the flame to either side, so that it can propagate to the adjacent ports 5, and thereby propagate quickly around the top ring. The flame then passes from the top ring down each of the other vertical rows.

The distance between vertical rows (i.e. the width of the fin piece 6 where it is attached to the burner head) is relatively large; in the neighborhood of 0.75 inches. This provides a wide path for secondary air to move vertically and feed both the fans of flame coming from the vertical rows and the ring of flame from the top ports. If this distance is decreased by putting in more vertical port rows, excessive carbon monoxide will be produced at the higher inputs indicating secondary air starvation. The requirement of this relatively wide spacing between vertical port rows necessitates a special provision to assure flame carry-around at low input; hence the need for the top port ring.

FIG. 1 shows fins which are deeper at the bottom of the vertical port row and shallower at the top. This is because there is a greater tendency for the flame to blow off the lower ports than off the upper ports.

Only a single tab-in port pair 4 is shown at the top of each port row. It is possible to have two or more tab-in port pairs at the top of each row, but doing so is not generally advantageous, since one tab-in port pair is usually sufficient to assure flame carry-around. Similarly, a single port pair 5 is generally sufficient in the location between port rows.

In summary, the simple sheet metal burner described is able to meet the seven aforementioned operational criteria by virtue of the effects produced by tabbed rectangular ports, sheet metal fins, and the proper arrangement of these elements on the sidewall of a vertical cylindrical hollow burner head. It is understood that modifications to the preferred embodiment could achieve similar operational results without departing from the scope and teachings of this specification.

What is claimed is:

1. An atmospheric gas burner comprising a single mixer tube connected at one end to a burner head and through which a mixture of air and gaseous fuel passes and enters the burner head;

said burner head being a hollow cylinder fabricated of sheet metal and oriented with the sidewall of the cylinder vertical;

said sidewall having a number of ports therethrough, through which pass said mixture of air and gaseous fuel and from which said mixture burns, each of said ports having a substantially rectangular shape and having a tab projecting from one of the long sides of the rectangle, said tab being formed of the sheet metal that has been sheared along three sides of the rectangle and then bent at a substantially right angle along the fourth side of the rectangle, and further that such ports are arranged in pairs, each pair laying within a second, larger rectangle, such that two sides of the second rectangle are formed by the tabbed edges of the ports and the other two sides of the second rectangle include the short edges of the ports, and further that the pairs are spaced in an array on the burner sidewall in which some of the pairs have the tabs projecting to the outside of the burner head and some of the pairs have the tabs projecting to the inside of the burner head;

said array comprising vertical rows of pairs, the rows equally spaced around the sidewall, each vertical row including a lower portion having pairs with the tabs oriented vertically and projecting outward, and an upper portion having pairs with the tabs oriented vertically and projecting inward;

one or more pairs located in the spaces between the vertical rows and adjacent to the upper tab-in portion of the vertical rows, such pairs acting in concert with the tab-in pairs to promote flame propagation to all ports when the burner is lit; and fins of sheet metal attached to said burner sidewall, one of said fins located on either side of each of said vertical rows of port pairs, the fins oriented in a vertical plane and projecting radially outward from the sidewall, and further having a vertical extent substantially from the lower pair of the associated vertical row to the uppermost tab-out pair of the vertical row, such fins aiding in maintaining attached and stable flames from the lower tab-out port pairs of each vertical row.

* * * * *